United States Patent [19]

Takahashi

[11] 4,243,141

[45] Jan. 6, 1981

[54] NEEDLE PACK

[75] Inventor: Masamitsu Takahashi, Hiroshima, Japan

[73] Assignee: Bankoku Needle Manufacturing Company Ltd., Hiroshima, Japan

[21] Appl. No.: 92,338

[22] Filed: Nov. 8, 1979

[51] Int. Cl.[3] ..... B65D 85/28

[52] U.S. Cl. ..... 206/380; 220/281; 220/282

[58] Field of Search ..... 206/382, 380, 383; 220/281, 282, 283

[56] References Cited

U.S. PATENT DOCUMENTS

| | | | |
|---|---|---|---|
| 3,348,724 | 10/1967 | Rosso | 220/381 |
| 3,760,972 | 9/1973 | McKirnan | 220/381 |
| 3,951,263 | 4/1976 | Vale | 206/382 |

*Primary Examiner*—Joseph Man-Fu Moy
*Attorney, Agent, or Firm*—George A. Loud

[57] ABSTRACT

The needle pack includes a base member, provided with a needle holder portion and a flexible cover member. The base member has one end edge attached to an end edge of the cover member and an engaging lug is formed at the other end of the cover member for engagement with a hole formed in the base member. The cover member is formed with a convex portion near the edge attached to the base member and a concave portion formed in contact with the base member adjacent to the convex portion whereby when the convex portion is pushed down, the cover member springs up due to the fulcrum action of the concave portion and the engaging lug is disengaged from the hole of the base member to open the cover member.

3 Claims, 5 Drawing Figures

NEEDLE PACK

BACKGROUND OF THE INVENTION

The present invention relates to a needle pack and more particularly to a needle pack from which a desired needle is easily withdrawn.

Conventional needle packages comprise a sheet cover having a holder portion, and a small card in which a plurality of needles are kept and which is wrapped by the sheet cover.

In use, after the sheet cover is opened, the small card is drawn from the holder portion of the sheet cover thereafter to remove a desired needle from the card.

However, the above conventional needle packages are not easy to handle and require troublesome steps including opening the the sheet cover, drawing the card from the holder portion of the sheet and removing the needle from the card as described above.

SUMMARY OF THE INVENTION

With the above in mind, an object of the present invention is to provide a needle pack from which is very easy to withdraw a desired needle kept therein by making the cover of the pack keeping therein needles enable to open at a press it opens upon application of pressure.

Another object of the invention is to provide a needle pack of which fabricating cost is reduced.

In one embodiment of the present invention, there is provided a needle pack comprising a substantially rectangular shaped base member provided with a needle holder portion, and a flexible transparent cover member, the base member being at an end edge thereof attached to an end edge of the cover member. An engaging lug is formed at the other end of the cover member for engage with a hole formed in the base member. The cover member is formed with a convex portion near the edge attached to the base member and a concave portion formed in contact with the base member adjacent to the convex portion whereby when the convex portion is depressed, the cover member springs up due to the fulcrum action of the concave portion and the engaging lug is disengaged from the hole of the base member to open the cover member.

BRIEF DESCRIPTION OF THE DRAWINGS

The feature and advantages of a needle pack according to the present invention will become more apparent from the following description taken in conjunction with the accompanying drawings, in which.

In the drawings, the same reference numerals indicate the same or a similar element of the needle pack according to the present invention.

DETAILED DESCRIPTION OF THE PREFERRED EMBODIMENT OF THE INVENTION

Figure 1:
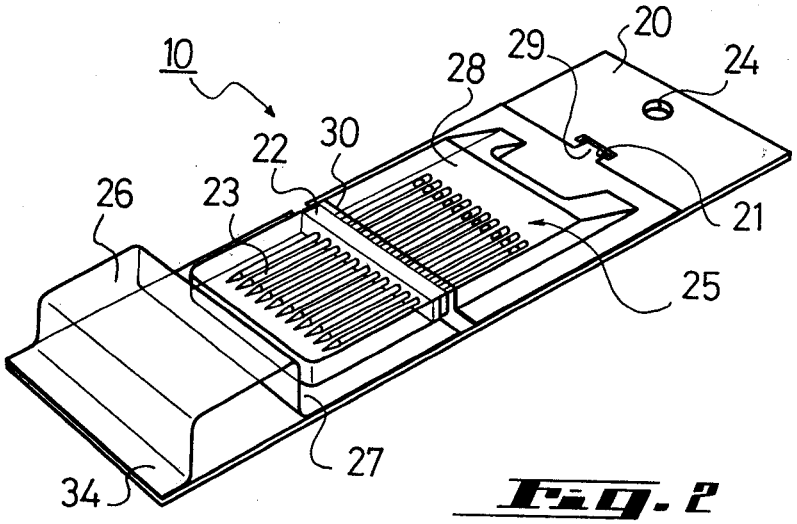
FIG. 1 is a perspective view which schematically illustrates a preferred embodiment of a needle pack according to the present invention.
Figure 2:
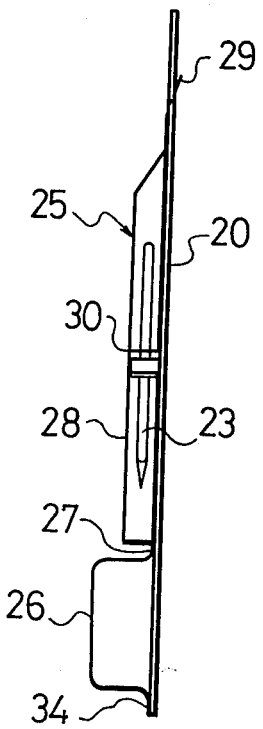
FIG. 2 is a side elevation of FIG. 1.

FIG. 1 shows a needle pack, designated by reference numeral 10, employed in the embodiment of the present invention wherein the needle pack comprises a card 20 serving as a base member, a needle holder portion 22 through which a plurality of needles 23 are kept, and a flexible transparent cover member 25, which components will be described in more detail.

Figure 3:
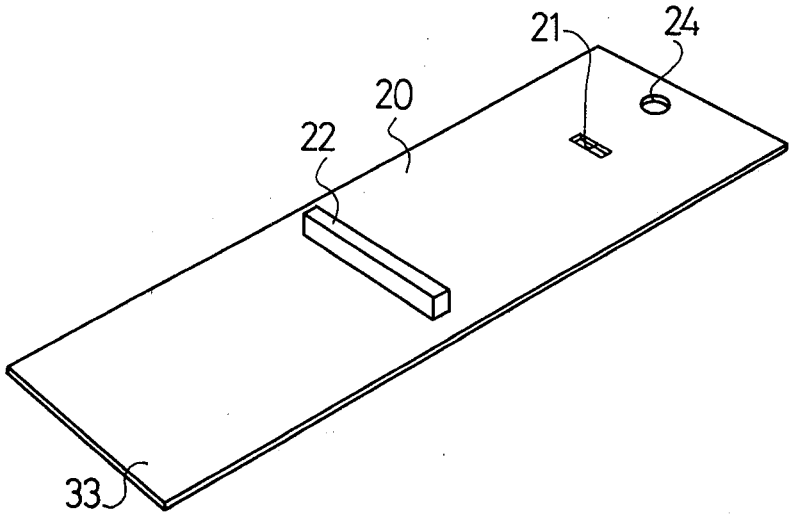
FIG. 3 is a perspective view which schematically illustrates a base member on which a needle holder portion is mounted, as shown in FIG. 1.

Referring to FIG. 3, the substantially rectangular shaped base member 20 is provided near an end thereof with a hole 21. The needle holder portion 22 of synthetic blister resin is mounted near the middle of the base member and may be made of polystyrene, polyethylene or synthetic rubber. Reference is now made in holding needles 23 to the needle holder portion 22. It is sufficient to directly stick needles 23 into the holder portion 22 or to provide a plurality of cuts or notches at constant intervals therein to insert the needles thereinto, thereby holding the middle portion of each of the needles between cuts and notches. The reference numeral 24 is a hole through which a pin or the like is passed to hang the needle pack 10.

Figure 4:
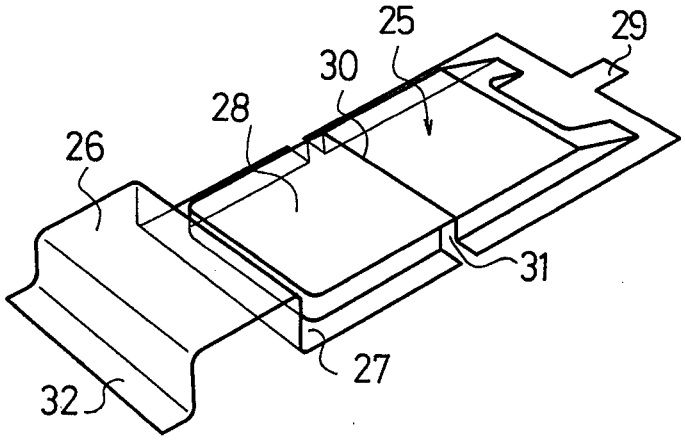
FIG. 4 is a perspective view which schematically illustrates the transparent cover member shown in FIG. 1.

Referring to FIG. 4, the flexible transparent cover member 25 of synthetic resin comprises a convex portion 26 formed at an end thereof, a concave portion 27 formed adjacent to the convex portion so as to be brought into contact with the top surface of the base member 20, a needle receiving portion 28 which is formed, with one end adjacent to the concave portion 27, as a hollow shell presenting an open side towards the base member 20, and an engaging lug 29 which is formed at the other end of the cover member 25. The flexible transparent cover member 25 of synthetic resin may be made of polyvinyl chloride, polyamide, polyester or acrylic acid resin. Further, the transparent cover member may be colorless or colored.

In the embodiment of the present invention shown in the drawings, the cover member 25 is creased or scored so as to present a folding line 30 which serves as a hinge. The folding line 30 is made such that when the needle receiving portion 28 is bent along the folding line 30, the needle receiving portion 28 is able to be returned to the initial position. The folding line 30 is located near the middle with respect to the longitudinal direction of the needle receiving portion 28. Cutout portions, each designated by reference numeral 31, are formed along the folding line 30 on both sides of the needle receiving portion 28 so as to make possible the bending action along the folding line 30 stated above possible.

One end edge, designated by reference numeral 32, of the cover member 25 is attached to one end edge, designated by reference numeral 33, of the base member 20, which comprises the attached portion 34, and the opposite edge of cover member 25 carries engaging lug 29 which is insertable into the hole 21 of the base member 20.

Figure 5:
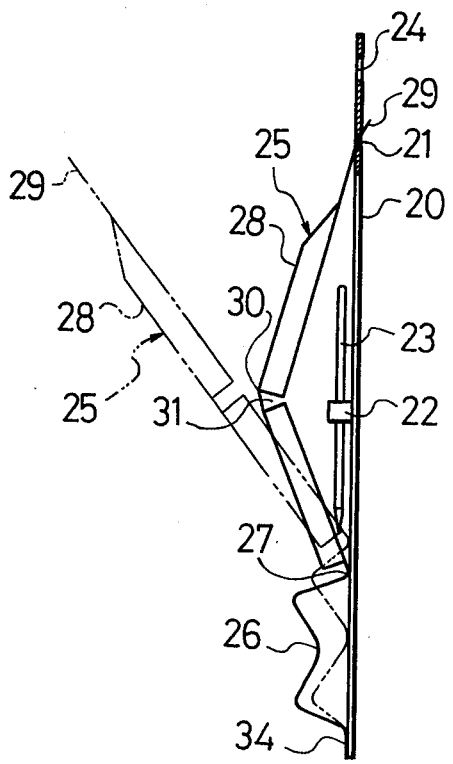
FIG. 5 is a partially-cutaway side elevation showing how the cover member is opened.

In using the embodiment of the invention shown in the drawings, the convex portion 26 of the cover member 25 is pushed towards the base member 20, so that the cover member 25 springs upwardly, as shown in FIG. 5 by the fulcrum action of the concave portion 27 formed in contact with the base member 20. In this manner the engaging lug 29, formed at the other end of the flexible cover member 25 is disengaged from the hole 21 of the base member 20, thereby opening the cover member 25 as shown in FIG. 5 by the two-dotted broken line. In the embodiment of the present invention wherein the folding line 30 is formed in the needle receiving portion 28 of the cover member 25, when the convex portion 26 of the cover member 25 is pushed down towards the base member 20 to spring up the cover member 25 as shown in FIG. 5, the concave portion 27 formed in contact with the base member 20 serves as a fulcrum to spring up along the folding line only the part of the needle receiving portion 28 located on the side of the fulcrum whereby the cover member 25 is bent along the folding line 30 serving as a hinge to form an inverse V-shape as shown in FIG. 5 by solid line to draw out and disengage the engaging lug 29 formed at the end of the cover member 25 from the hole 21 of the base member 20. As a result, the cover member 25 is returned from the bent position to the initial position by the restoring force given to the folding line, so that the cover member 25 is opened quite smoothly as shown in FIG. 5 with two-dotten broken line to open the needle pack, and then it is possible to draw a desired one of needles 23 holded in the needle holder portion 22.

As will be obvious from the foregoing description, with the needle pack according to the present invention, it is quite easy to withdraw a desired needle from the needle holder portion because it is possible to open the needle pack simple by pressing with one hand on the convex portion of the cover member.

It is to be noted that modification and variation of the embodiments of the invention disclosed herein may be resorted to without departing from the spirit of the invention or the scope of the appended claims.

What is claimed is

1. A needle pack comprising a substantially rectangular base member, a needle holder attached to said base member, and a substantially rectangular flexible cover member attached to said base member at one end edge, said flexible cover member comprising a first convex portion covering said needle holder portion and any needles held therein;

engagement means for securing the end edge of said cover member, opposite said attached end edge, to said base member;

means for opening said first convex portion including a second convex portion and a concave portion separating said second convex portion from said first convex portion, whereby when pressure is applied to said second convex portion force is transmitted through said concave portion, said concave portion serving as a fulcrum, to disengage said engagement means and to force said first convex portion away from said base member, thereby opening the needle pack for use.

2. The needle pack of claim 1 wherein said engagement means includes a lug on the end edge of said cover member opposite said attached end edge and a hole formed in said base member for receiving said lug.

3. The needle pack of claim 1, wherein said first convex portion is creased or scored so as to present a folding line which serves as a hinge so that upon opening said first convex portion is bent along the folding line and assumes an inverted V-shape.

* * * * *

UNITED STATES PATENT AND TRADEMARK OFFICE

CERTIFICATE OF CORRECTION

PATENT NO. : 4,243,141

DATED : January 6, 1981

INVENTOR(S) : Masamitsu Takahashi

It is certified that error appears in the above—identified patent and that said Letters Patent is hereby corrected as shown below:

Col. 1, line 18, "the the" should read ---the---;

line 26, delete "keeping therein needles enable" and insert ---so that---;

line 27, delete "to open at a press";

line 38, "engage" should read ---engagement---;

line 49, "feature" should read ---features---;

Col. 2, line 52, "stated above possible" should read ---described above---;

line 63, after "Fig. 5" insert ---,---.

Col. 3, line 24, "holded" should read ---held---.

Col. 4, line 8, after "comprising" insert ---:---.

Signed and Sealed this

*Seventh* Day of *April 1981*

[SEAL]

*Attest:*

RENE D. TEGTMEYER

*Attesting Officer*

*Acting Commissioner of Patents and Trademarks*